US006450437B1

(12) United States Patent
Figge et al.

(10) Patent No.: US 6,450,437 B1
(45) Date of Patent: Sep. 17, 2002

(54) REEL CONFIGURATION FOR WINDING THINLY ROLLED FINISHED STRIP

(75) Inventors: Dieter Figge, Essen; Slegfried Pohl, Duisburg, both of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/856,596

(22) PCT Filed: Nov. 26, 1999

(86) PCT No.: PCT/DE99/03855

§ 371 (c)(1),
(2), (4) Date: May 23, 2001

(87) PCT Pub. No.: WO00/32326

PCT Pub. Date: Jun. 8, 2000

(30) Foreign Application Priority Data

Nov. 30, 1998 (DE) ..... 198 56 767

(51) Int. Cl.[7] ..... B65H 19/26; B65H 19/30

(52) U.S. Cl. ..... 242/524; 242/527; 242/531.1; 242/533.4

(58) Field of Search ..... 242/524, 526, 242/527, 527.1, 527.2, 527.3, 527.4, 527.5, 527.6, 527.7, 531.1, 533.4, 533.5, 533.6

(56) References Cited

U.S. PATENT DOCUMENTS 2,258,348 A * 10/1941 Biggert ..... 242/531.1
3,087,688 A * 4/1963 Anderson et al. ..... 242/524
3,100,605 A * 8/1963 Bond ..... 242/531.1
3,670,611 A * 6/1972 Jarman ..... 83/81
4,389,868 A * 6/1983 Strout
4,458,852 A * 7/1984 Calvert et al. ..... 242/524
4,550,881 A * 11/1985 Boardman ..... 242/527.7
4,930,711 A * 6/1990 Morizzo ..... 242/527.7
4,964,583 A * 10/1990 Yukumoto et al. ..... 242/527.7
5,769,149 A * 6/1998 Mertens

FOREIGN PATENT DOCUMENTS

JP 57009532 A * 1/1982
JP 61186152 A * 8/1986
JP 2-217113 * 8/1990 ..... 242/533.4
JP 06285711 A * 10/1994

* cited by examiner

*Primary Examiner*—John M. Jillions
(74) *Attorney, Agent, or Firm*—Cohen, Pontani, Lieberman & Pavane

(57) ABSTRACT

A reel configuration for winding thinly rolled finished strip after passing through a cooling section situated at the end of an installation for the continuous rolling of hot strip cross sections from thin slabs which are cast with near-final dimensions, on one of two expandable reel mandrels arranged such that they float in a horizontal and parallel manner with respect to one another. The mandrels are mounted such that they are rotatably driven independently of one another in a supporting structure which can rotate about a common horizontal center axis and to which the finished strip coming from the finishing train can be fed by means of a driver-shear combination. High speed emergency shears are arranged upstream of the driver-shear combination and have assigned to them a collecting space underneath the plane of the roller table for receiving the residual material from the finishing train.

6 Claims, 1 Drawing Sheet

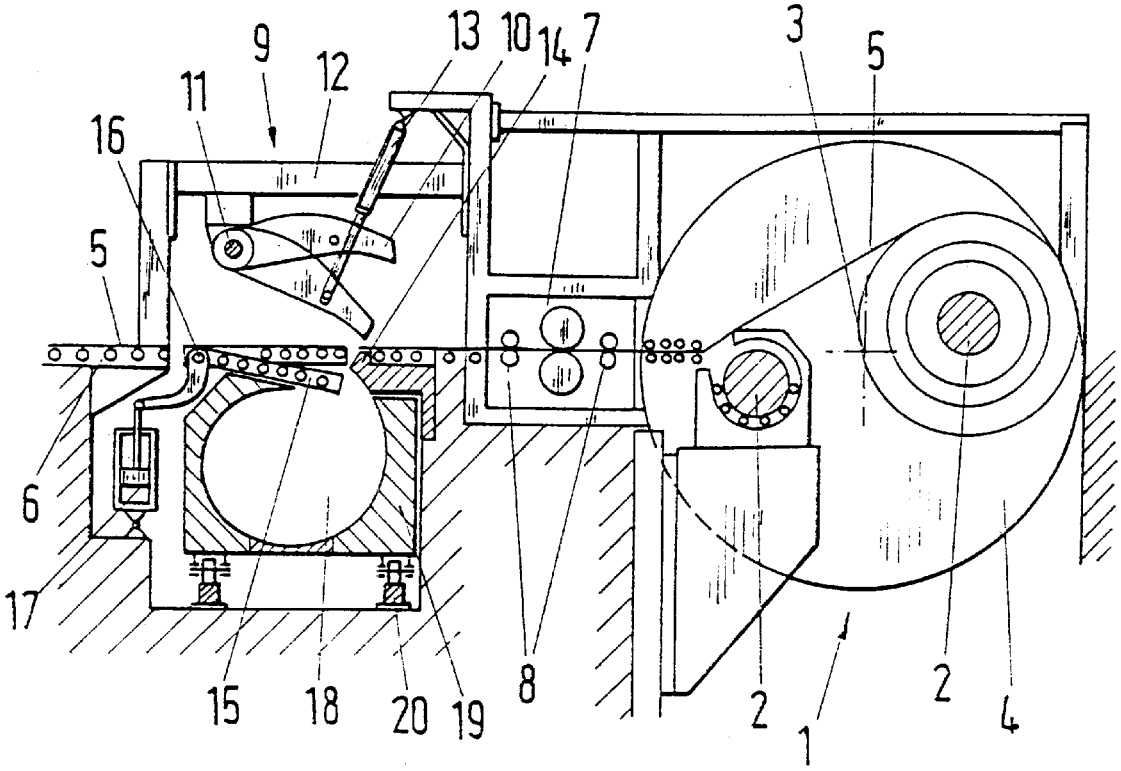
9
12
13
10
14
7
3
5
11
16
5
6
17
15
18
20
19
8
2
1
2
4

REEL CONFIGURATION FOR WINDING THINLY ROLLED FINISHED STRIP

BACKGROUND OF THE INVENTION

1. Field of the Invention

The invention relates to a reel configuration for winding thinly rolled finished strip after passing through a cooling section situated at the end of an installation for the continuous rolling of hot strip cross sections from thin slabs which are cast with near-final dimensions, especially on one of two expandable reel mandrels which are arranged such that they float in a horizontal and parallel manner with respect to one another, which are mounted such that they are rotatably driven independently of one another in a supporting structure which can rotate about a common horizontal center axis and to which the finished strip coming from the finishing train can be fed by means of a driver-shear combination.

2. Description of the Related Art

In the past, slabs of finite length heated up in hot strip trains were rolled individually into coils weighing from 15 t to 25 t. The winding up of these strips took place at the end of the rolling train usually onto underfloor reels; in the event of trouble in the area of the reel, it was possible without any problem to stop the rolling of the next slab or switch the strip material to the untroubled second reel.

More recent hot strip trains are designed for continuous rolling or virtually continuous rolling. Virtually continuous rolling means here that 5 to 10 slabs are continuously rolled into a thin strip of, for example, 1 mm in thickness to then return to the single-slab rolling with strip thicknesses of, for example, 2 to 6 mm.

The wish to carry out continuous rolling has two main reasons. The first is that in continuous rolling the tension in the rolled stock can be kept constant, i.e. there are no changes in profile and flatness at the ends of the strip attributable to different tensile conditions.

The second reason is that in continuous operation of single-slab rolling the desired small hot strip thicknesses of <1 mm as a substitute for expensive cold strip cannot be brought in front of the reel by means of the cooling roller table in a trouble-free manner. The very thin strip has a tendency to fly up right at the end of the strip, further exacerbated by the relatively high speeds with which the thinnest strips are to be rolled to avoid reductions in production output.

For continuous rolling, a special thin-strip reel in the form of a carousel coiler is often used, because this offers advantages for winding at high speed. The most important advantages are the possibility of the strip running in horizontally and the adoption of different positions for the initial winding and the final winding. The dividing up of the strip into the lengths necessary for the respective coil size or coil weight is performed by means of high-speed parting shears upstream of the reel, which are usually combined with drivers. These driver-shear combinations make it possible for the strip to be introduced and cut off without having to reduce the speed for the initial winding of a new coil.

Despite better preconditions, now and again trouble can occur during continuous rolling and winding in a coiler, in particular a carousel coiler, in that the initial winding of the strip does not succeed, which leads to a failure in the area of the carousel coiler. On account of the configuration of the installation, it is not possible to interrupt the continuous rolling immediately, because the continuous strand coming from the casting installation is in all the rolling stands of the finishing train. Although shears upstream of the finishing train can be actuated, preventing further material from running into the finishing train, it must nevertheless be ensured that the finishing train continues rolling until it is empty, which lasts about 10 to 15 s. During this time, in the event of a failure, the residual amounts of material from the finishing stands still enter the troubled area of the reel and cause great chaos there, which also affects the area upstream of the coiler, that is the driver-shears assembly.

SUMMARY OF THE INVENTION

On the basis of the problems and disadvantages of the prior art described, it is an object of the invention to design a reel configuration in such a way that, in the case of trouble during the initial winding of the strip on the reel mandrel, the installation can be shut down without trouble occurring in the area of the reels or drivers.

To achieve the object, it is proposed according to the invention that high-speed emergency shears are arranged upstream of the driver-shear combination and have assigned to them outside, preferably underneath, the plane of the roller table a collecting space for receiving the residual material from the finishing train. The emergency shears have the task of cutting off the finished strip in the direct vicinity of the reel configuration in the event of trouble and directing it into a collecting space, i.e. leading it out of the rolling line.

In a preferred embodiment of the invention, it is provided that the emergency shears are designed as pendulum shears arranged above the roller table, with a counter-cutter arranged in a fixed manner in the plane of the roller table and a scrap receiving container for the residual material being provided underneath said counter-cutter as a collecting space. The pendulum shears or guillotine shears cut through the finished strip at high speed, in that the movable cutter chops through the finished strip from above and, acting together with the fixed counter-cutter in the plane of the roller table, leads the cut-off residual material into the scrap receiving container arranged underneath.

According to another feature of the invention, the scrap receiving container can be moved laterally, transversely with respect to the roller table, for emptying. For this purpose, the container is provided with wheels which can move on rails.

To lead the residual material of the cut-off finished strip into the collecting space or the scrap receiving container, it is provided that a part of the roller table arranged directly upstream of the emergency shears and the collecting space is capable of being lowered. This part of the roller table need not only be lowered in the case of trouble; during continuous rolling, this may be carried out as a preventive measure whenever the beginning of the strip has been taken up and tensioned by the drivers. As a result, access to the scrap collecting container is always free, so that in the case of emergency no switching time is lost.

The emergency shears according to the invention are preferably able to be triggered abruptly by means of a hydraulic cylinder unit with upstream accumulator. As a result, it is ensured that in the case of trouble the emergency shears can react immediately.

In a further embodiment, it is proposed that unused dynamic energy is used up in springs, which at the same time limit the path of the pendulum shears. Such springs take up that part of the energy not used by the cut of the residual material and retard the downward path of the upper cutter to a standstill.

BRIEF DESCRIPTION OF THE DRAWINGS

The sole FIGURE is a schematic cross-section of the reel configuration according to the invention.

DETAILED DESCRIPTION OF THE PRESENTLY PREFERRED EMBODIMENTS

A carousel coiler 1 has reel mandrels 2 arranged such that they are rotatably driven independently of one another in the supporting structure 4 which can rotate about a common horizontal axis 3. The finished strip 5 coming from a finishing train (not represented) is fed via the roller table 6 to the combined driver-shear unit 7, which grips the beginning of the strip by means of the driver rollers 8 and feeds it to the reel mandrel 2 situated in the winding-up position. One of the reel mandrels 2 grips the beginning of the finished strip 5 and begins winding the strip. After that, the initially wound strip is swiveled together with this reel mandrel 2 into the second winding position by rotating the supporting structure 4 about the horizontal axis 3. The meanwhile emptied second reel mandrel is in this case positioned into the initial winding position and is ready for the initial winding of a new strip. Once the coil weight has been reached, the finished strip is cut through by the driver-shear unit 7 and the trailing strip, the beginning of a new strip, is passed to the reel 2 situated in the initial winding position, for renewed initial winding.

The initial winding of the very thin finished strip may lead to trouble in the area of the carousel coiler 1, necessitating interruption of the initial winding operation. The cutting off of the finished strip with the driver-shear unit 7 is not suitable in this case to avoid chaos in the area of the reel, because the finishing train arranged upstream of the reel configuration transports further residual material in the direction of the reel configuration even if parting shears (not represented) used upstream of the finishing train interrupt the supply to the finishing train. At least the residual amounts of finished strip located in the finishing train would be transported at the rolling rate into the troubled area of the reel if measures were not taken to prevent this.

The present invention solves the problem with the emergency shears, denoted overall by 9, which are designed as pendulum shears. The upper cutter 10 of these pendulum shears can be swiveled about a horizontal swivel axis 11 on their supporting structure 12 with the aid of the hydraulic-cylinder unit 13 into a cutting position, in which the upper cutter 10 cuts through the finished strip by interacting with the lower cutter 14. Through a lowerable part 15 of the roller table, which can be swiveled downward at 16 about a horizontal axis—driven by the piston-cylinder unit 17—, the cut-through finished strip 5 is directed into the collecting space 18, which is dimensioned such that at least the amount of residual material from the finishing train can be accommodated. The collecting space 18 is formed in a scrap receiving container 19, which can be moved out on rails 20 transversely with respect to the roller table 6 in order to be emptied outside the area of the roller table.

The high-speed emergency shears, the hydraulic-cylinder unit of which can be actuated abruptly by means of pressure accumulators (not represented), create the possibility of effecting a very quick interruption in the passage of the finished strip in the event of trouble and of leading the amount of residual material cut-off upstream of the finishing train away into the scrap receiving container arranged underneath the roller table 6. Damage to the reel configuration is avoided, just as a chaotic accumulation of amounts of finished strip upstream of the reel is also avoided.

What is claimed is:

1. An apparatus for winding up thinly rolled finished strip, said apparatus comprising a roller table for receiving the finished strip from a rolling installation, said roller table defining a plane which supports the finished strip, a supporting structure which can rotate about a horizontal axis, two expandable reel mandrels mounted in said supporting structure so that they can float in a horizontal and parallel manner with respect to one another and said axis, said mandrels being rotatably driven independently of one another, a driver-shear combination for feeding said finished strip to one of said mandrels, high speed emergency shears arranged upstream of said driver shear combination, and a collecting space outside the plane of the roller table, said collecting space being positioned to receive said strip after shearing by said emergency shears.

2. An apparatus as in claim 1 wherein said emergency shears comprise a pendulum shear which pivots about a horizontal axis above the roller table, and a counter-cutter fixed in the table, said collecting space being defined by a scrap receiving container underneath said counter-cutter.

3. An apparatus as in claim 2 wherein said scrap receiving container is movable laterally with respect to the roller table, transversely to the direction of travel of said finished strip.

4. An apparatus as in claim 2 wherein said roller table comprises a pivotable part immediately upstream of said counter cutter, said pivotable part being pivotable downward by said pendulum shear to direct said strip into said scrap receiving container.

5. An apparatus as in claim 1 further comprising a hydraulic cylinder unit and an accumulator for abruptly triggering said emergency shears.

6. An apparatus as in claim 2 further comprising springs which absorb dynamic energy of said pendulum shear and limit its travel.

* * * * *